US011308802B2

(12) United States Patent
Schuller et al.

(10) Patent No.: US 11,308,802 B2
(45) Date of Patent: Apr. 19, 2022

(54) METHOD FOR THE AT LEAST PARTIALLY AUTOMATED OPERATION OF A MOTOR VEHICLE

(71) Applicant: AUDI AG, Ingolstadt (DE)

(72) Inventors: Florian Schuller, Ismaning (DE); Christian Feist, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 310 days.

(21) Appl. No.: 16/623,888

(22) PCT Filed: Jun. 14, 2018

(86) PCT No.: PCT/EP2018/065776
§ 371 (c)(1),
(2) Date: Jan. 31, 2020

(87) PCT Pub. No.: WO2019/001975
PCT Pub. Date: Jan. 3, 2019

(65) Prior Publication Data

US 2020/0349838 A1 Nov. 5, 2020

(30) Foreign Application Priority Data

Jun. 28, 2017 (DE) ..... 10 2017 210 961.0

(51) Int. Cl.
*G08G 1/0968* (2006.01)
*G08G 1/0967* (2006.01)

(52) U.S. Cl.
CPC . *G08G 1/096827* (2013.01); *G08G 1/096725* (2013.01); *G08G 1/096775* (2013.01); *G08G 1/096844* (2013.01)

(58) Field of Classification Search
CPC ..... G08G 1/096827; G08G 1/096725; G08G 1/096775; G08G 1/096844
(Continued)

(56) References Cited

U.S. PATENT DOCUMENTS 5,933,100 A 8/1999 Golding
6,321,162 B1 11/2001 Hessing
(Continued)

FOREIGN PATENT DOCUMENTS

DE 19747230 A1 5/1999
DE 102012021282 A1 4/2014
(Continued)

OTHER PUBLICATIONS

International Search Report and Written Opinion of the International Searching Authority directed to related International Patent Application No. PCT/EP2018/065776, dated Oct. 18, 2018, with attached English-language translation; 14 pages.
(Continued)

*Primary Examiner* — B M M Hannan
(74) *Attorney, Agent, or Firm* — Sterne, Kessler, Golstein & Fox P.L.L.C.

(57) ABSTRACT

The invention relates to a method for the at least partially automated operation of a motor vehicle. The method includes ascertaining a planned trajectory to be traversed by the motor vehicle. The method further includes transmitting plan data relating to the planned trajectory from the motor vehicle to a central device on the infrastructure side and evaluating a release condition, the meeting of which depends on the plan data, by means of the central device. The method also includes transmitting a release message from the central device to the motor vehicle if the release condition has been met, and transmitting a modification message from the central device to the motor vehicle if the release condition has not been met. The planned trajectory is ascertained again on the motor vehicle side upon receiving a modification message in order to determine another planned trajectory.

14 Claims, 1 Drawing Sheet

(58) Field of Classification Search
USPC ..... 701/24
See application file for complete search history.

(56) References Cited

U.S. PATENT DOCUMENTS

| | | | | |
|---|---|---|---|---|
| 8,825,265 | B1 * | 9/2014 | Ferguson | G05D 1/0214 701/26 |
| 8,880,272 | B1 * | 11/2014 | Ferguson | G08G 1/096725 701/26 |
| 8,996,224 | B1 * | 3/2015 | Herbach | G05D 1/0044 701/23 |
| 9,008,890 | B1 * | 4/2015 | Herbach | G05D 1/0297 701/26 |
| 9,442,489 | B2 | 9/2016 | Reichel et al. | |
| 10,037,689 | B2 * | 7/2018 | Taylor | G06K 7/10475 |
| 10,042,359 | B1 * | 8/2018 | Konrardy | B60W 30/16 |
| 10,185,998 | B1 * | 1/2019 | Konrardy | B60R 21/00 |
| 10,198,943 | B2 * | 2/2019 | Raamot | G08G 1/052 |
| 10,351,240 | B1 * | 7/2019 | Sills | H04B 7/18506 |
| 10,446,029 | B2 | 10/2019 | Hoffmann et al. | |
| 10,532,770 | B2 * | 1/2020 | Khlifi | B62D 15/025 |
| 2014/0172300 | A1 * | 6/2014 | Reich | G08G 1/163 701/537 |
| 2017/0010618 | A1 * | 1/2017 | Shashua | B60W 30/10 |
| 2017/0069209 | A1 * | 3/2017 | Beaurepaire | G08G 1/0125 |
| 2017/0124781 | A1 * | 5/2017 | Douillard | G01S 17/931 |
| 2017/0297625 | A1 | 10/2017 | Irion et al. | |
| 2018/0348767 | A1 * | 12/2018 | Jafari Tafti | G08G 1/163 |
| 2020/0318979 | A1 * | 10/2020 | Gonopolskiy | G01C 21/3446 |
| 2021/0312811 | A1 * | 10/2021 | Ohlarik | G06N 5/04 |
| 2021/0366281 | A1 * | 11/2021 | Yagasaki | G08G 1/0969 |
| 2021/0389139 | A1 * | 12/2021 | Szubbocsev | G01C 21/3415 |

FOREIGN PATENT DOCUMENTS

| | | | | |
|---|---|---|---|---|
| DE | 102014221771 | A1 | 4/2016 | |
| DE | 102014221777 | A1 | 4/2016 | |
| DE | 102016218876 | A1 * | 3/2018 | B60W 50/14 |
| EP | 2911926 | A2 | 9/2015 | |
| EP | 3109591 | A1 | 12/2016 | |
| EP | 3144920 | A1 * | 3/2017 | G08G 1/166 |
| GB | 2412281 | A | 9/2005 | |

OTHER PUBLICATIONS

International Preliminary Report on Patentability directed to related International Patent Application No. PCT/EP2018/065776, dated Sep. 13, 2019, with attached English-language translation; 13 pages.

* cited by examiner

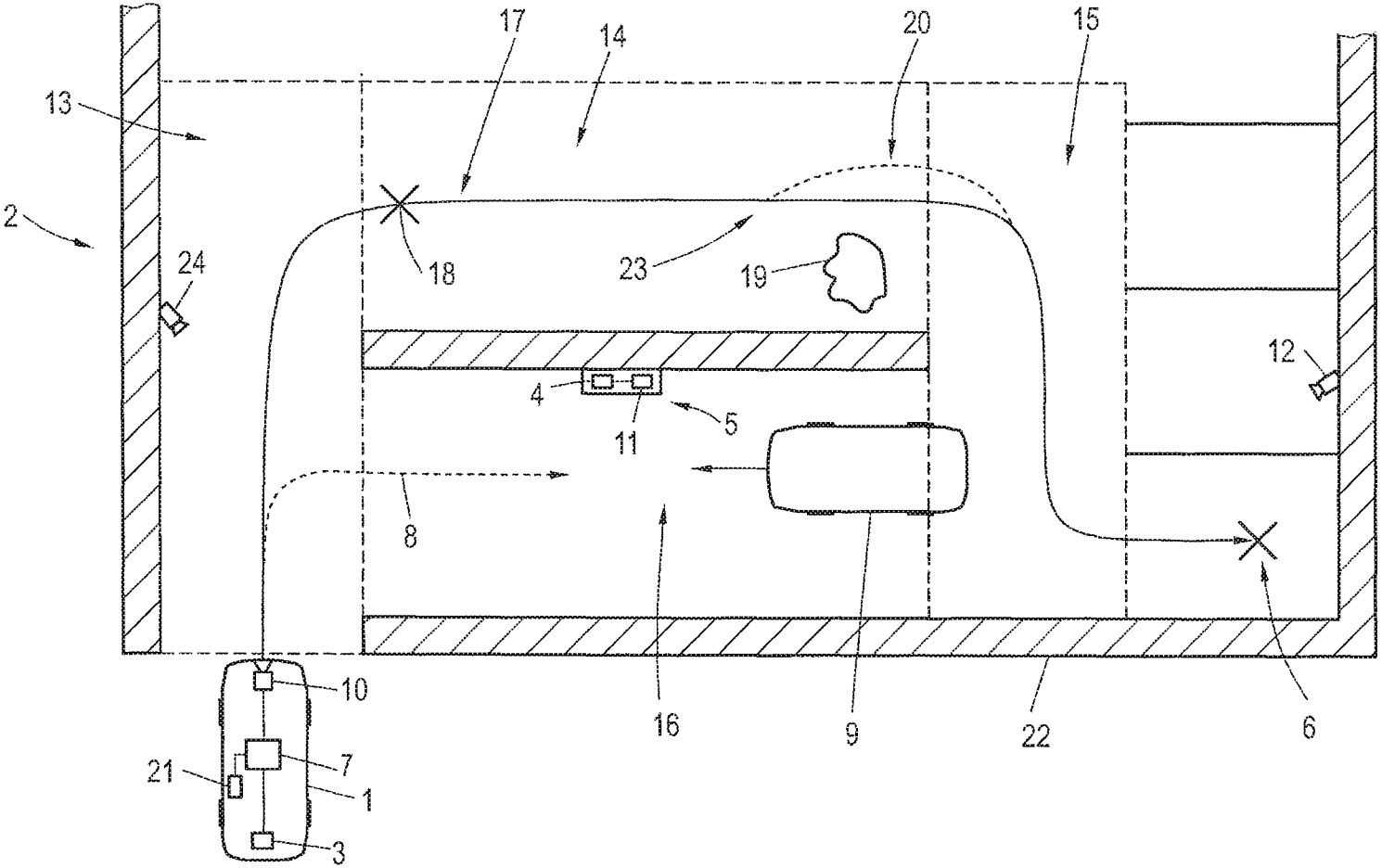
2
13
24
17
14
18
20
15
23
19
12
5
4
11
8
16
9
22
6
10
7
1
3
21

METHOD FOR THE AT LEAST PARTIALLY AUTOMATED OPERATION OF A MOTOR VEHICLE

TECHNICAL FIELD

The invention relates to a method for the at least partially automated operation of a motor vehicle. The invention additionally relates to a motor vehicle and a central device.

BACKGROUND

Hitherto, parking operations have mostly taken place manually, that is, the driver himself drives his vehicle from a driveway to a parking lot. He is himself responsible for all operations. Parking guidance systems can be used to assist the driver in choosing a route within the car park.

In order to relieve a driver of such parking operations, it is in principle possible to guide the motor vehicle at least by partially automated means to a target position. With partially automated guidance, the longitudinal and transverse guidance of the motor vehicle is carried out by a control device on the motor vehicle side. This guidance can be made possible without a permanent monitoring of the driver, which is also referred to as highly or fully automated operation of the motor vehicle. In order to realize an at least partially, automated operation, a digital a priori map of the vehicle environment can be used to plan a travel path and to move the motor vehicle with sensor support without collision along this travel path. A self-location with respect to the digital map can take place for example by a satellite-based navigation system.

Such an approach is known, for example, from the document DE 10 2014 221 777 A1. Here, a digital map of a parking lot and a target position are received by the motor vehicle via a communication network, after which the motor vehicle navigates autonomously in the parking lot to the target position based on the digital map.

From the document DE 197 47 230 A1 an approach for route searching is known, in which a starting point and a destination are transferred by the motor vehicle to a central computer. On the central computer, a route plan is created, taking into account supplementary traffic information. With the aid of a digital road map, location codes are determined for the route sections used by the determined route and transmitted to the motor vehicle. In the internal digital road map of the motor vehicle, the route sections thus identified are modified in such a way that they are preferably taken into account when planning a route over other route sections.

The problem with the known approaches to trajectory planning is that, in the case of trajectory planning on the vehicle side, coordination of the driving operation between different vehicles is hardly possible or involves considerable coordination effort. In addition, there is no information in the vehicle about obstacles which, on the one hand, are not mapped and, on the other hand, cannot be detected by the vehicle sensor system. Trajectory planning is thus only possible with a very limited planning horizon. However, a shift in trajectory planning to a central facility also has considerable disadvantages. On the one hand, the central device cannot robustly assess whether a specific trajectory can actually be traversed by a specific motor vehicle. In addition, it is often not possible to achieve the same degree of detail of the trajectory planning; as in the case of planning on the vehicle side, since typically only relatively coarseresolution environmental data can be acquired via a sensor system on the infrastructure side.

BRIEF DESCRIPTION OF THE DRAWINGS/FIGURES

FIG. 1 illustrates a schematic diagram of a driving situation, a motor vehicle, and a central device, according to some embodiments of this disclosure.

DETAILED DESCRIPTION

The invention is therefore based on the object of specifying an improved method for planning an at least partially automated driving operation.

The object is achieved according to the invention by a method for the at least partially automated operation of a motor vehicle, including the following steps:

ascertaining a planned trajectory to be traversed by the motor vehicle as part of the at least partially automated operation on the motor vehicle side, transmitting plan data relating to the planned trajectory from the motor vehicle to a central device on the infrastructure side, evaluating a release condition, the meeting of which depends on the plan data, by means of the central device, transmitting a release message from the central device to the motor vehicle if the release condition has been met, and transmitting a modification message from the central device to the motor vehicle if the release condition has not been met, where the planned trajectory is ascertained again on the motor vehicle side upon receiving a modification message in order to ascertain another planned trajectory.

According to the invention, it is thus proposed to carry out the trajectory planning on the motor vehicle side, thus achieving the advantages of planning on the motor vehicle side. In particular, high-resolution sensor data available in the motor vehicle can be used, and concrete properties of a motor vehicle can be taken into account in the planning. For example, turning radii, an acceleration or braking capacity and/or, for example, the possibility of adjusting a running gear by means of an actuator on the vehicle side can be taken into account. However, since a release or modification request is made by a central device, robust coordination between multiple automobiles can be achieved, and obstacles known only to the central device can be considered early in the planning. By this procedure, the planning horizon for an at least partially automated guidance of the motor vehicle can be considerably expanded. Finally, since the central device decides on the implementation of the planned trajectories, a defined system state and a predictable behavior of the vehicles can always be ensured.

The plan data transmitted to the central device can describe the planned trajectory in detail. However, it is also possible that they only describe which partial areas of the vehicle surroundings or of a driving area assigned to the central device are covered by this planned trajectory. This can be specified in particular as a function of time or the planned trajectory can be planned on a time-dependent basis. For example, it is possible to determine certain times at which certain segments of the planned trajectory are likely to be driven, or a driving speed for certain sections. As will be explained in detail later, it is possible that the central device proposes a proposed trajectory. If the motor vehicle takes this on as a planning trajectory, it may be sufficient for the planning data to indicate that this is the case.

The planning of the planning trajectory described above can be repeated during the driving operation of the motor vehicle, in particular periodically, until the at least partially automated operation of the motor vehicle is ended and/or a target position is reached. For example, a determination of planned trajectories can take place every second or at intervals of several seconds. However, shorter or longer time intervals can be used.

Preferably, mutually identical map data is used to determine the planned trajectory on the motor vehicle side and to check the release condition on the central device side. This makes it possible to assign identical identifications, on both the motor vehicle side as well as the central device side, to identical elements and subareas in the motor vehicle environment or in a driving region assigned to the central device, so that, for example, information relating to the guidance of a trajectory through such a subarea or the blocking or releasing of such a subarea, can be easily and reliably exchanged between the motor vehicle and the central device.

The map data can in particular be synchronized or exchanged between the central device and the motor vehicle. For example, the central device can transmit the map data relating to this driving area to the motor vehicle when entering a driving area which is assigned to the central device.

Before the determination of the planned trajectory and/or in the context of the modification message, a target position to be reached by the planned trajectory and/or a proposed trajectory for the at least partially automated operation of the motor vehicle and/or at least one trajectory rule to be met by the planned trajectory can be met, and/or sensor data relating to a driving area associated with the central device is transmitted from the central device to the motor vehicle. Such a transfer of preliminary information potentially enables a better planned trajectory to be determined and/or the determination of the planned trajectory can be accelerated since additional information is available to the motor vehicle. In addition, the probability of determining a planned trajectory that meets the release condition is increased, which may require no or a few iterations in the context of determining the planned trajectory.

The planned trajectory can be determined on the motor vehicle side as a function of the transmitted data. That is, the planned trajectory can be determined as a function of the target position and/or the proposed trajectory and/or the trajectory rule and/or the sensor data. For example, the proposed trajectory can be used as a starting point for the planning and can only be varied locally or with respect to its time profile in order to achieve the driveability of the motor vehicle and/or to take account of obstacles identified on the motor vehicle side. The planned trajectory can be determined so that it leads to the target position and/or the trajectory rule is met.

In addition, or as an alternative to the above-mentioned information, the central device can transmit information about other road users in the driving area to the motor vehicle and this information can be taken into account in the context of determining the planned trajectory. The other road users can be motor vehicles, which also determine planned trajectories and transmit them to the central facility. Alternatively, or additionally, however, other road users, for example manually guided motor vehicles and/or pedestrians, may also be taken into account. Alternatively, it is possible to take account of information about other road users already in the context of specifying the target position and/or the trajectory rule and/or the proposed trajectory. In particular, by appropriate formulation of the trajectory rule that conflicts between different road users can be avoided.

The trajectory rule can describe at least one blocked area and/or required area of the travel area, where the planned trajectory is determined in such a way that the motor vehicle is continuously within the required area and/or continuously outside the blocked area during guidance according to the planned trajectory. It is thus possible to positively or negatively define the driving area which is usable or which is to be used. The required area and/or the blocked area can be predetermined in a time-dependent manner. For example, certain areas of the driving area can only be blocked if they are to be used to guide another road user within this area.

The trajectory rule can also specify at least one path to be traveled or a driving route to be traveled. The path or the driving route can specify the geometry of the planned trajectory, where a temporal sequence of the planned trajectory can be determined by the motor vehicle. It is also possible to specify at least one section of the planned trajectory or of the path or of the driving route, where the trajectory planning takes place outside this section purely on the motor vehicle side and/or where at least one of the sections is selected on the motor vehicle side and taken into account in the determination of the planned trajectory.

The map data may describe a plurality of subareas of one or the driving area assigned to the central device, the planned trajectory being determined such that it covers the same subareas that are covered by the proposed trajectory. The proposed trajectory can thus roughly specify through which subareas, for example, along which roads or route sections, the motor vehicle should be guided, while the planned trajectory can specify a particular more detailed guidance of the motor vehicle within these subareas.

The proposed trajectory can be used as a planned trajectory if, by evaluating motor vehicle data acquired from the motor vehicle side and/or motor vehicle data relating to the motor vehicle, it is determined that it is likely to be drivable. A proposed trajectory may not be drivable, for example, if a sensor system on the motor vehicle side detects an obstacle that blocks driving along the proposed trajectory. Taking account of motor vehicle data makes it possible in particular to check the kinematic feasibility of the proposed trajectory by the motor vehicle. For example, it can be checked whether the proposed trajectory can be driven with the turning circle that can be achieved by the vehicle or whether a proposed trajectory, which is predetermined as a function of time, can be driven with the acceleration or braking possibilities of the motor vehicle. Other parameters of the motor vehicle can also be taken into account, for example a low ground clearance of the motor vehicle, which can prevent driving over certain uneven ground or sudden changes in gradient.

The transmitted sensor data can be determined with the aid of a sensor system on the infrastructure side. Additionally, or alternatively, it is possible that additional sensor data are detected by other motor vehicles and first transmitted to the central device, after which they can be provided by this to the motor vehicle.

Before and/or during the guidance of the motor vehicle according to the planned trajectory, the instantaneous position and/or the instantaneous speed of the motor vehicle can be transmitted to the central device. If, at this point in time, there is still manual guidance of the motor vehicle or if the motor vehicle is stationary, then this information can be used by the central de-vice for coordination between the various road users in the driving area. Additionally, or alternatively, the central device can monitor the driving operation of the motor vehicle on the basis of the transmitted information, for example to detect deviations from a planned trajectory.

The driving operation of the motor vehicle can be monitored during the guidance in accordance with the planned trajectory, where a modified planned trajectory is determined by the planned trajectory in the event of an already occurring and/or an anticipated future deviation of the driving operation of the motor vehicle. The determination of the changed planned trajectory can be carried out in particular if a measure of the deviation is greater than a predetermined limit value. The determination of the changed planned trajectory can be carried out according to the preceding explanations. In particular, the planned trajectory can first be determined on the motor vehicle side and transmitted to the central device, after which said device can release the planned trajectory or request the determination of another planned trajectory. If the monitoring of the driving operation is performed by the central device, a reason for the re-planning can be transmitted as part of the request for re-planning. If, however, unprompted by the motor vehicle, planning of a modified planned trajectory, takes place, a reason for re-planning can also be transmitted.

The monitoring of the driving operation can take place on the motor vehicle side. In particular, it can be recognized on the motor vehicle side that a future deviation from the planned trajectory will be required because, for example, a hitherto unrecognized obstacle is detected. If this is recognized in good time, the driving operation of the motor vehicle can initially be continued in accordance with the already released planned trajectory, while the motor vehicle plans a modified planned trajectory and has it released by the central device.

Alternatively, or additionally, however, the monitoring can also take place on the central device side. For this purpose, the position and/or speed of the motor vehicle can be transmitted from the motor vehicle to the central device and/or can be detected by sensor, in particular by a sensor system on the infrastructure side. The central device can also recognize that the vehicle guidance is likely to deviate from the planned trajectory in the future, if it is detected by a sensor system on the infrastructure side or due to data transmission by third parties that there is an obstacle in the area of the planned trajectory.

In addition to the method according to the invention, the invention relates to a motor vehicle with a communication device for communication with a central device and a control device for at least partially automated guidance of the motor vehicle, where the control device is designed for carrying out the method according to the invention. The control device can control at least one actuator of the motor vehicle in order to guide the motor vehicle at least by partially automated means. Preferably, the motor vehicle has a sensor system on the motor vehicle side for detecting the motor vehicle environment and/or a position determining device for determining an intrinsic position of the motor vehicle. The intrinsic position can serve to locate the motor vehicle with respect to the predetermined map data.

In addition, the invention relates to a central device with a communication device for communication with at least one motor vehicle and a processing device controlling the communication device, where the processing de-vice is set up for carrying out the method according to the invention. The central device preferably includes a sensor system on the infrastructure side or a sensor system on the infrastructure side provides information to the central device.

The motor vehicle according to the invention and the central device according to the invention can be further developed with the features described for the method according to the invention with the advantages explained there, and vice versa.

Further advantages and details of the invention will become apparent from the following embodiments and the accompanying drawings. The FIGURE shows schematically a driving situation in which an embodiment of the method according to the invention is carried out by an embodiment of the motor vehicle according to the invention and an embodiment of the central device according to the invention.

FIG. 1 shows a driving situation in which a motor vehicle 1 is to be parked automatically in an infrastructure facility 2, for example a parking garage. The automated parking can preferably be carried out without continuous supervision by a driver, in particular without a driver located in the motor vehicle 1. In principle, however, a partially automated operation of the motor vehicle 1 would be possible in which the longitudinal and transverse guidance of the motor vehicle takes place automatically by a corresponding control of an actuator, not shown, of the motor vehicle 1 by the control device 7, but the driving operation is permanently monitored by the driver.

When driving into a driving area assigned to the infrastructure 2, the motor vehicle 1 communicates via the communication device 3 on the motor vehicle side and the communication device 4 of a central device 5 with the central device 5 in order to obtain information regarding the automatic guidance or to enable a coordination of the driving operation of the motor vehicle 1 with other motor vehicles, such as the motor vehicle 9. A data exchange between the central device 5 and the motor vehicle 1 is carried out in particular repeatedly, for example, at fixed intervals. In this case, the motor vehicle can transmit to the central device 5, for example, its determined positions via a position-determining device 21, for example a satellite-based position-determining system, and/or its current driving speed and/or direction of travel. The position of the motor vehicle could also be determined by recognizing natural or artificial landmarks in environmental data. This can be recorded in digital map data, so that a vehicle position can be determined on the basis of the determination of a relative position of the motor vehicle with respect to, in particular; several landmarks.

Upon entry into the infrastructure facility 2, a target position 6, for example an allocated parking space, is first transmitted from the central device 5 to the motor vehicle 1 as part of an initial communication. Moreover, in order to ensure that the motor vehicle 1 and the central device 5 use a common database as part of the planning of the driving operation, the central device 5 provides the motor vehicle 1 with digital map data which describes the infrastructure facility 2, in particular existing travel paths or non-passable areas. In addition, subareas or objects in this map data can be assigned unambiguous identifications, so that they can be referred to in the context of the communication between the motor vehicle 1 and the central device 5. For example, the subareas 13, 14, 15, 16 of the driving area associated with the central device 5 can be identified in the map data. In addition, other elements, such as the walls 22 or other obstacles may be identified in the map data.

On the basis of the received map data and the received target position, a planned trajectory 8, which brings the motor vehicle 1 to the target position 6 or approaching the target position 6, is planned by the control device 7 of the motor vehicle 1. As shown in FIG. 1, the shortest travel path is first selected here. Although this is not actually passable, since it is blocked by the oncoming motor vehicle 9, since the oncoming motor vehicle 9 cannot yet be detected by the sensors 10 of the motor vehicle 1, this fact can not be taken into account in the planning of the planned trajectory 8.

In order to be able to use additional information of the central device 5 or to enable a coordination of the operation of the motor vehicles 1, 9, the motor vehicle 1 transmits the planning data concerning the planned trajectory 8 to the central device 5. The planning data can describe the planned trajectory 8 in detail, but it is also possible to transmit only a reduced amount of information, for example exclusively that this trajectory passes over the travel areas 13, 16. In particular, the planning data also describe a time dependence of the planned trajectory. If the planned trajectory is transmitted, it is possible, for example, to transmit times which are assigned to individual waypoints of the planned trajectory, and at which they are likely to be reached, and/or travel speeds. If, for example, only an occupancy of certain subareas 13, 16 is transmitted, it is additionally possible to transmit when these subareas 13, 16 are expected to be occupied by the motor vehicle 1.

The processing device 11 of the central device 5 then evaluates a release condition, the meeting of which depends on whether the planned trajectory 8 is likely to be drivable according to the data collected in the central device or if driving on the planned trajectory 8 is likely to hinder driving movement of other motor vehicles 9. Information which is not initially available in the motor vehicle 1 is present in the central device 5. On the one hand, sensor data of a sensor system 12, 24 on the infrastructure side can be detected, with which, for example, the motor vehicle 9 and its direction of travel and speed can already be detected. In order to enable an efficient coordination of the driving operation of several motor vehicles 1, 9, positions and/or speeds of the motor vehicles 1, 9 and in particular also driving intentions, for example planned trajectories or currently driven trajectories, can be transmitted to the central device. Based on this information, it is determined whether the planned trajectory 8 is likely to be drivable or is appropriate in the context of a coordination of motor vehicles 1, 9. If this is the case, then the release condition is met and the central device 5 transmits a release message to the motor vehicle 1. Upon receipt of this release message, the control device 7 can activate the actuator, not shown, in order to guide the motor vehicle along the planned trajectory 8.

As explained above, however, the planned trajectory 8 is not passable in the present case, which is why the release condition is not met. The central device 5 thus sends a modification message to the motor vehicle 1 in order to instruct the motor vehicle or its control device 7 to determine another planned trajectory. In order to achieve efficient planning, additional information can be transmitted to the motor vehicle as part of the modification message or separately therefrom. Various possibilities for this are explained below. In principle, it would also be possible to transmit this information before the planning of the first planned trajectory 8.

The central device 5 can transmit a trajectory rule to the motor vehicle 1, which to be met by the planned trajectory. In the example shown, it could be transmitted as a trajectory rule, for example, that the subarea 16 is a blocked area, the planned trajectory is then determined such that the motor vehicle is continuously located outside the blocked area when guided in accordance with the planned trajectory. By prediction of the driving operation of the motor vehicle 9, it is also possible to determine blocking periods for corresponding blocked areas which indicate when these blocked areas are blocked. Conversely, by the trajectory rule it would also be possible to specify as target areas, for example, the subareas 13, 14, 15 through which the planned trajectory is to be guided. Based on the explained trajectory rules, the motor vehicle can determine the planned trajectory 17 and transmit it to the central device. Since, as far as can be recognized by the central device 5, this trajectory is drivable and does not hinder any further motor vehicles 9, the central device 5 subsequently transmits a release message to the motor vehicle 1, after which the automated driving operation along the trajectory 17 can be started.

In an alternative embodiment, it would be possible for the central unit 5 to transmit the sensor data of the sensors 12, 24 on the infrastructure side to the motor vehicle 1. Based on this sensor data, the control device 7 of the motor vehicle 1 can recognize that the partial region 16 should be avoided and thus likewise arrive at the determination of the planned trajectory 17.

If a large part of the trajectory planning is to be carried out on the central device side, it is also possible for the processing device 11 to already determine a proposed trajectory along which the motor vehicle 1 could potentially be guided and transmit it to the motor vehicle 1. In this case, by evaluating the data of the vehicle's own sensor system 10, the control device 7 of the motor vehicle 1 can determine whether the driving of the proposed trajectory is obstructed by obstacles which under some circumstances may not be known to the central device 5. In addition, motor vehicle data describing driving possibilities, dimensions or the like of the motor vehicle can be taken into account. For example, it is possible to check whether the proposed trajectory is drivable with the available acceleration and braking potential of the motor vehicle 1, the turning circle and the dimensions thereof. If the control device 7 determines that the proposed trajectory is likely to be drivable, it can be adopted as a planned trajectory and corresponding planning data, which can also only indicate that the planned trajectory corresponds to the proposed trajectory, can be transmitted to the central device 5 in order to await a final release. If the proposed trajectory is not directly drivable, it can be varied in order to arrive at a planned trajectory. For example, curve radii can be adjusted, detours can be added to circumvent obstacles, or the like. Preferably, the planned trajectory is determined such that it leads through the same subareas 13 to 16 of the driving range as the proposed trajectory.

During the driving operation of the motor vehicle 1 along the planned trajectory 17 it is continuously determined whether re-planning of the planned trajectory 17 is required. A corresponding re-planning is required, for example, when the central device 5 recognizes from the received position or speed data of the motor vehicle 1 and/or from the sensor system 12, 24 on the infrastructure side that the driving operation of the motor vehicle 1 deviates from the planned trajectory 17. In this case, a request for re-planning can be sent to the motor vehicle 1, where in particular the cause for the re-planning, that is to say the deviation from the planned trajectory 17, can also be transmitted.

On the other hand, re-planning of the planned trajectory can be initiated on the motor vehicle side. For example, when the position 18 is reached by the motor vehicle 1 with the sensor system 10 on the motor vehicle side, the presence of an obstacle 19 can be detected, which prevents further travel on the planned trajectory 17. The motor vehicle 1 can send a corresponding message, in particular already together with a modified planned trajectory 20, to the central device 5. For the modified planned trajectory 20, as explained above, the release condition is checked and either a release message or a modification message is sent to the motor vehicle 1. If the position 18 at which the planning of the modified planned trajectory 20 is started, is sufficiently far away from the position 23 at which the previous planned trajectory 17 and the new planned trajectory 20 part, then the driving operation along the planned trajectory 17 can initially be continued while the modified planned trajectory is determined and released by the central facility 5.

The invention claimed is:

1. A method for at least partially automated operation of a motor vehicle, the method comprising:

ascertaining a planned trajectory to be traversed by the motor vehicle as part of the at least partially automated operation of the motor vehicle;

transmitting plan data relating to the planned trajectory from the motor vehicle to a central device;

receiving, at the motor vehicle, a release message from the central device in response to a release condition being met, wherein the release condition is evaluated at the central device based on the plan data; and receiving, at the motor vehicle, a modification message from the central device in response to the release condition not being met, wherein the planned trajectory is ascertained again at the motor vehicle upon receiving the modification message to determine another planned trajectory.

2. The method according to claim 1, further comprising:

using, at the motor vehicle, mutually identical map data to determine the planned trajectory, wherein the mutually identical map data is used at the central device to check the release condition.

3. The method according to claim 2, wherein:

the mutually identical map data describes a plurality of subareas of a driving area or the driving area assigned to the central device, the planned trajectory is determined such that it covers same subareas that are covered by a proposed trajectory determined by the central device for the at least partially automated operation of the motor vehicle.

4. The method according to claim 3, further comprising:

using the proposed trajectory as the planned trajectory, in response to, by evaluating motor vehicle data acquired from the motor vehicle and/or motor vehicle data relating to the motor vehicle, it is determined that the proposed trajectory is drivable.

5. The method according to claim 1, further comprising:

before the ascertaining the planned trajectory, receiving, at the motor vehicle and from the central device, a target position to be reached by the planned trajectory, a proposed trajectory determined by the central device for the at least partially automated operation of the motor vehicle, at least one trajectory rule to be met by the planned trajectory, and/or sensor data relating to a driving area associated with the central device.

6. The method according to claim 5, wherein:

the at least one trajectory rule describes at least one blocked area and/or a required area of a travel area, and the planned trajectory is determined in such a way that the motor vehicle is continuously located within the required area or continuously outside the at least one blocked area during guidance of the motor vehicle according to the planned trajectory.

7. The method according to claim 5, wherein the sensor data is determined using a sensor system on an infrastructure side.

8. The method according to claim 1, further comprising:

transmitting, from the motor vehicle to the central device and before and/or during guidance of the motor vehicle according to the planned trajectory, a position and/or a speed of the motor vehicle.

9. The method according to claim 1, wherein: a driving operation of the motor vehicle is monitored during guidance of the motor vehicle according to the planned trajectory, a modified planned trajectory is determined in response to an occurring and/or anticipated future deviation of the at least partially automated operation of the motor vehicle.

10. The method according to claim 1, wherein the receiving the modification message further comprises:

receiving, at the motor vehicle and from the central device, a target position to be reached by the planned trajectory, a proposed trajectory determined by the central device for the at least partially automated operation of the motor vehicle, at least one trajectory rule to be met by the planned trajectory, and/or sensor data relating to a driving area associated with the central device.

11. The method according to claim 10, wherein:

the at least one trajectory rule describes at least one blocked area and/or a required area of a travel area, and the planned trajectory is determined in such a way that the motor vehicle is continuously located within the required area or continuously outside the at least one blocked area during guidance of the motor vehicle according to the planned trajectory.

12. The method according to claim 10, wherein the sensor data is determined using a sensor system on an infrastructure side.

13. A motor vehicle, comprising:

a communication device configured to communicate with a central device; and a control device configured for at least partially automated operation of the motor vehicle, wherein the control device is configured to:

ascertain a planned trajectory to be traversed by the motor vehicle as part of the at least partially automated operation of the motor vehicle;

transmit, using the communication device, plan data relating to the planned trajectory to the central device;

receive, using the communication device, a release message from the central device in response to a release condition being met, wherein the release condition is evaluated at the central device based on the plan data; and receive, using the communication device, a modification message from the central device in response to the release condition not being met, wherein the planned trajectory is ascertained again upon receiving the modification message in order to determine another planned trajectory.

14. A central device, comprising:

a communication device configured to communicate with at least one motor vehicle; and a processing device configured to control the communication device, the processing device configured to:

receive, using the communication device and from the at least one motor vehicle, plan data relating to a planned trajectory, wherein the planned trajectory is ascertained at the at least one motor vehicle to be traversed by the at least one motor vehicle as part of at least partially automated operation of the at least one motor vehicle;

evaluate a release condition based on the plan data;

transmit, using the communication device and to the at least one motor vehicle, a release message in response to the release condition being met; and transmit, using the communication device and to the at least one motor vehicle, a modification message from the central device in response to the release condition not being met, wherein the planned trajectory is ascertained again at the at least one motor vehicle upon transmitting the modification message in order to determine another planned trajectory.

* * * * *